US012721372B2

(12) United States Patent
Graf et al.

(10) Patent No.: US 12,721,372 B2
(45) Date of Patent: Sep. 1, 2026

(54) CARTRIDGE

(71) Applicant: PHILIP MORRIS PRODUCTS S.A., Neuchâtel (CH)

(72) Inventors: Didier Graf, Salvenach (CH); James Lynch, Dublin (IE); Jimmy Rennick, Sandymount (IE); Giovanna Landi, Mur (CH); Morten Grøsfjeld, Sellebakk (NO); Alexandra Lindén, Linköping (SE); Peter Norrby, Mjölby (SE); Przemyslaw Romanow, Peseux (CH); Eoin McNally, Dublin (IE); Bryan Murphy, County Dublin (IE)

(73) Assignee: Philip Morris Products S.A., Neuchâtel (CH)

( * ) Notice: Subject to any disclaimer, the term of this patent is extended or adjusted under 35 U.S.C. 154(b) by 597 days.

(21) Appl. No.: 17/628,832

(22) PCT Filed: Jul. 22, 2020

(86) PCT No.: PCT/IB2020/056919
§ 371 (c)(1),
(2) Date: Jan. 20, 2022

(87) PCT Pub. No.: WO2021/014388
PCT Pub. Date: Jan. 28, 2021

(65) Prior Publication Data

US 2022/0264949 A1 Aug. 25, 2022

(30) Foreign Application Priority Data

Jul. 23, 2019 (EP) ..... 19187937

(51) Int. Cl.
*A24F 40/42* (2020.01)
*A24F 1/30* (2006.01)
(Continued)

(52) U.S. Cl.
CPC ..... *A24F 40/42* (2020.01); *A24F 1/30* (2013.01); *A24F 40/20* (2020.01); *A24F 40/485* (2020.01); *B65D 73/0028* (2013.01)

(58) Field of Classification Search
None
See application file for complete search history.

(56) References Cited

U.S. PATENT DOCUMENTS 4,944,317 A * 7/1990 Thal ..... A24D 1/14 131/348
9,433,241 B2 * 9/2016 Jalloul ..... A24F 5/04
(Continued)

FOREIGN PATENT DOCUMENTS

CN 101423134 B * 10/2011
CN 205221523 U 5/2016
(Continued)

OTHER PUBLICATIONS

My Baby Care, Screen Captures from Youtube video entitled "LuvLap Moisturising Wet Wipes with Lid", www. Youtube.com. Accessed via: https://www.youtube.com/watch?v=Dzfdj1XczD4 (Year: 2018).*

(Continued)

*Primary Examiner* — Manley L Cummins, IV
(74) *Attorney, Agent, or Firm* — Mueting Raasch Group

(57) ABSTRACT

A cartridge includes a body with a side wall and at least one lid arranged to cover a top or a bottom, or both. The cartridge comprises a cavity inside the body configured for receiving an aerosol-forming substrate. The lid includes an inner layer facing the cavity and an outer layer facing an outside of the body. The inner layer comprises a weakened region. When the outer layer is removed, the weakened region of the inner layer forms an aperture. The cavity is in fluid communication with an outside of the cartridge body via the formed aperture. The aerosol-forming substrate may include
(Continued)

tobacco. The cartridge may be a shisha cartridge and the aerosol-forming substrate may be a shisha substrate, such as hookah tobacco.

20 Claims, 7 Drawing Sheets

(51) Int. Cl.
*A24F 40/20* (2020.01)
*A24F 40/485* (2020.01)
*B65D 73/00* (2006.01)

(56) References Cited

U.S. PATENT DOCUMENTS

| | | | | |
|---|---|---|---|---|
| 2005/0247713 | A1 | 11/2005 | Niederer et al. | |
| 2009/0071978 | A1* | 3/2009 | Sharp | B65D 73/0028 222/541.9 |
| 2010/0101590 | A1* | 4/2010 | Pflaum | A24F 1/30 131/222 |
| 2012/0145739 | A1* | 6/2012 | Doyle | B65D 75/327 225/56 |
| 2014/0069446 | A1* | 3/2014 | Haddad | A24F 1/30 427/2.14 |
| 2018/0199624 | A1* | 7/2018 | Ammar | A24D 1/14 |
| 2019/0124977 | A1* | 5/2019 | Bonnely | A24F 42/10 |
| 2021/0321663 | A1* | 10/2021 | Hagen | B65D 25/108 |
| 2024/0225100 | A1* | 7/2024 | Qian | B32B 27/10 |

FOREIGN PATENT DOCUMENTS

| | | | | |
|---|---|---|---|---|
| DE | 102016120786 | A1 * | 5/2018 | B65B 51/225 |
| EP | 2179667 | | 4/2010 | |
| GB | 2447958 | A * | 10/2008 | B65D 75/326 |
| JP | 2002096879 | A * | 4/2002 | |
| JP | 6239234 | B2 * | 11/2017 | B65D 77/206 |
| KR | 10-2018-0125500 | A | 11/2018 | |
| WO | WO 2017/178930 | A1 | 10/2017 | |
| WO | WO-2017216593 | A1 * | 12/2017 | A24F 1/30 |
| WO | 20190003116 | | 1/2019 | |
| WO | WO-2020043225 | A1 * | 3/2020 | A24F 1/30 |

OTHER PUBLICATIONS

Amazon, "LuvLap Moisturising Wet Wipes with Lid". Accessed via: https://www.amazon.in/LuvLap-Paraben-Free-Wipes-Fliptop/dp/B0817S14MZ?th=1#customerReviews. (Year: 2018).*
Amazon, "Wet Wipe manufacturing date". Accessed via: https://www.amazon.in/LuvLap-Paraben-Free-Wipes-Fliptop/dp/B0817S14MZ?th=1#customerReviews. (Year: 2018).*
English Translation of CN_101423134 (Year: 2011).*
English Translation of DE_102016120786 (Year: 2018).*
English Translation of JP_2002096879 (Year: 2002).*
English Translation of JP_6239234 (Year: 2017).*
European Search Report and Written Opinion for EP 19187937.8 issued by the European Patent Office, Jan. 20, 2020; 9 pgs.
International Search Report and Written Opinion for PCT/IB2020/056919 issued by the European Patent Office, Sep. 30, 2020; 15 pgs.
International Preliminary Report on Patentability for PCT/IB2020/056919, issued Feb. 3, 2022; 9 pages.
Chinese Office Action for CN 202080048081.6 issued by the China National Intellectual Property Administration Jan. 26, 2025; 20 pgs. including English translation.
Korean Office action for KR Application No. 10-2022-7002157, issued by the Korean Patent Office on Jun. 30, 2025; 9 pgs. including English translation.
Korean Office Action for KR 10-2022-7002157 issued by the Korean Patent Office on Mar. 24, 2026; 8 pgs. Including English translation..

* cited by examiner

CARTRIDGE

This application is the § 371 U.S. National Stage of International Application No. PCT/IB2020/056919, filed 22 Jul. 2020, which claims the benefit of European Application No. 19187937.8, filed 23 Jul. 2019, the disclosures of which are incorporated herein by reference.

This disclosure relates to cartridges for housing an aerosol-forming substrate, particularly for use in aerosol-generating devices. The cartridge has a lid that includes one or more weakened regions, where apertures form when an outer layer of the lid is removed. Embodiments of the present disclosure relate to cartridges, to devices, to shisha devices, and to cartridges comprising an aerosol-forming substrate for use in shisha devices.

Traditional shisha devices are used to smoke tobacco and are configured such that vapor and smoke pass through a water basin before inhalation by a consumer. Shisha devices may include one outlet, or more than one outlet so that the device may be used by more than one consumer at a time. Use of shisha devices is considered by some to be a leisure activity and a social experience.

Typically, traditional shishas are used in combination with a substrate, sometimes referred to in that art as hookah tobacco, tobacco molasses, or simply as molasses. Traditional shisha substrates are relatively high in sugar (in some cases, up to ~50% vs. the ~20% typically found in conventional tobacco substrates, such as in combustible cigarettes). The tobacco used in shisha devices may be mixed with other ingredients to, for example, increase the volume of the vapor and smoke produced, to alter flavor, or both.

Traditional shisha devices employ charcoal, such as charcoal pellets to heat and sometimes combust the tobacco substrate to generate an aerosol for inhalation by a user. Using charcoal to heat the tobacco may cause full or partial combustion of the tobacco or other ingredients. Additionally, charcoal may generate harmful or potentially harmful products, such as carbon monoxide, which may mix with the shisha vapor and pass through the water basin to the outlet.

One way to reduce the production of carbon monoxide and combustion by-products is to employ e-liquids rather than tobacco. Shisha devices that employ e-liquids eliminate combustion by-products but deprive shisha consumers of the traditional tobacco-based experience.

Other shisha devices have been proposed that employ electric heaters to heat, but not combust, tobacco. Such electrically heated heat-not-burn shisha devices heat the tobacco substrate to a temperature sufficient to produce an aerosol from the substrate without combusting the substrate, and therefore reduce or eliminate by-products associated with combustion of tobacco.

Shisha devices may employ a cartridge for housing an aerosol-forming substrate. The cartridge may be filled with such aerosol-forming substrate. The aerosol-forming substrate may comprise tobacco, preferably shisha substrate, such as molasses—a mixture of tobacco, water, sugar, and other components, such as glycerine, flavors, etc. The heating system of the electrically heated shisha device heats the contents of the cartridge to generate aerosol, which is conveyed through an airflow path to a user.

In order to facilitate airflow through the cartridge and the flow of the aerosol from the cartridge, a shisha cartridge may have one or more holes through one or more walls. The cartridge may include one or more holes at the top, one or more holes at the bottom, or both one or more holes at the top and one or more holes at the bottom. The holes may also be disposed along the sides of the cartridge.

The holes or openings in the cartridge, if left unsealed, may lead to loss of freshness (for example, moisture content) or contamination of the substrate, as well as issues with leakage. For one or more reasons, such as in order to maintain freshness, to prevent leakage of the substrate, or to preserve the quality and integrity of the substrate during storage, it is desirable to close or seal the openings or holes of the cartridge prior to use or between uses if the entire contents of the cartridge are not used at once.

It would be desirable to provide a cartridge, such as a shisha cartridge, that remains sealed until an outer layer of the lid is removed. It would be desirable to provide a cartridge, such as a shisha cartridge, where one or more openings are automatically formed in the cartridge body when the outer layer of the lid is removed. It would be desirable to provide a shisha cartridge where the outer layer of the lid is part of an outer packaging.

According to embodiments of the present disclosure, there is provided a cartridge for housing an aerosol-forming substrate. The cartridge may comprise a body. The body may comprise a side wall and at least one lid arranged to cover a top, a bottom, or both the top and the bottom. The cartridge may comprise a cavity inside the body. The cavity may be configured for receiving the aerosol-forming substrate. The at least one lid may comprise an inner layer facing the cavity and an outer layer facing an outside of the body. The inner layer may comprise a weakened region. When the outer layer is removed, the weakened region of the inner layer may form an aperture. The cavity may be in fluid communication with an outside of the cartridge body via the formed aperture. In some embodiments, the aerosol-forming substrate comprises tobacco. In some embodiments, the cartridge is a shisha cartridge and the aerosol-forming substrate comprises a shisha substrate, such as hookah tobacco. In some embodiments, one or more additional openings are provided in the body of the cartridge, as will later be described. Advantageously this provides an airflow path through the cartridge.

According to embodiments of the present disclosure, there is provided a cartridge for housing an aerosol-forming substrate. The cartridge comprises a body. The body comprises a side wall and at least one lid arranged to cover a top, a bottom, or both the top and the bottom. The cartridge comprises a cavity inside the body. The cavity is configured for receiving the aerosol-forming substrate. The at least one lid comprises an inner layer facing the cavity and an outer layer facing an outside of the body. The inner layer comprises a weakened region. When the outer layer is removed, the weakened region of the inner layer forms an aperture. The cavity is in fluid communication with an outside of the cartridge body via the formed aperture. In some embodiments, the aerosol-forming substrate comprises tobacco. In some embodiments, the cartridge is a shisha cartridge and the aerosol-forming substrate comprises a shisha substrate, such as hookah tobacco. In some embodiments, one or more additional openings are provided in the body of the cartridge, as will later be described. Advantageously this provides an airflow path through the cartridge.

Various embodiments of the present disclosure relate to a cartridge that includes a lid with an inner layer facing the cavity and an outer layer facing the outside of the body of the cartridge. The inner layer has a weakened region. When the outer layer is removed, the weakened region of the inner layer forms an aperture. In some embodiments, when the outer layer is removed, the weakened region of the inner layer deforms to form an aperture. In some embodiments, when the outer layer is removed, the weakened region of the inner layer undergoes mechanical failure to form an aperture. The weakened region can assume various shapes and sizes. The weakened region may comprise a plurality of weakened regions. The weakened region may be made up of a pattern of a plurality of weakened regions. The plurality of weakened regions may be arranged in a homogeneous distribution across the inner layer. In some embodiments, the pattern is made up of dots, parallel lines, non-parallel lines, a spiral pattern, or a combination thereof. The lid may cover the top or the bottom, or both the top and bottom of the cartridge. Advantageously, a plurality of weakened regions may reduce the amount of force applied by a user to remove the outer layer so as to form an aperture in the inner layer. Advantageously, providing a pattern of a plurality of weakened regions may help to ensure formation of an aperture in the inner layer when the outer layer is removed, regardless of one or more of: an orientation, a direction of force, and amount of force applied by a user to remove the outer layer. Advantageously, an even distribution of a plurality of weakened regions helps to ensure formation in the inner layer of one or more apertures when the outer layer is removed.

The term "weakened region" is used herein to refer to a region or portion that is weaker (for example, has lower mechanical strength) than regions surrounding the weakened region. The weakened region may comprise a line of breakage. When sufficient force is applied to the lid (for example, by pulling, peeling, or tearing), a mechanical failure (for example, tearing) occurs at the weakened region. The mechanical failure may occur along the line of breakage. The weakened region may be achieved in any suitable manner. For example, the weakened region may be achieved by providing a reduced mechanical strength in the area of the weakened region. Examples of ways to achieve a reduced material strength include a reduced thickness in material, a perforation or scoring, etching, laser cutting, providing a weaker material than in the surrounding area, providing a frangible material or region, or providing an adhesive in the weakened region and no adhesive in the surrounding area. Frangible material is understood to mean a material that breaks when a force is applied to it, without deforming elastically and retaining its cohesion as a single object.

In some embodiments, the weakened region may be formed by scoring the inner layer. In some embodiments, the weakened region may be formed by pressing a region of the inner side of the lid. In some embodiments, the weakened region may be formed by thinning or weakening the material by etching, laser, etc. In some embodiments, the weakened region may be formed adhering a portion of the inner layer to the outer layer by an adhesive and not adhering an adjacent portion.

The outer layer may be part of an outer packaging that at least partially surrounds the body of the cartridge. When the cartridge is removed from the outer packaging, the outer layer is removed from the body and an aperture is formed on the inner layer.

In embodiments where the lid covers only one of the top and bottom, the other one of the top and bottom may comprise holes and a removable sticker or film covering the holes. Alternatively, the other one of the top and bottom may be without holes and may be pierceable. Piercing may be done using the shisha device or an accessory. In embodiments where the lid covers only the bottom, the top may be an open top covered by a removable lid where removal of the lid exposes the open top.

Some embodiments of the present disclosure relate to a shisha cartridge. In some embodiments, the cartridge is a shisha cartridge that includes a lid with an inner layer facing the cavity and an outer layer facing the outside of the body of the shisha cartridge. The inner layer has a weakened region. When the outer layer is removed, the weakened region of the inner layer forms an aperture. The weakened region can assume various shapes and sizes. The weakened region may be made up of a pattern of weakened regions. The lid can cover the top or the bottom, or both the top and bottom of the shisha cartridge.

The cartridge may be closed prior to use. Prior to use, a user may remove the outer layer of the lid from the cartridge. Apertures are formed in the top or bottom or both the top and bottom by removing the outer layer of the lid. Advantageously, the cartridge may be easy to use. Advantageously, the use of the cartridge may be clean and intuitive. The cartridge may provide less chance of leaking of the contents. The cartridge may therefore advantageously be better for storage and transportation. The cartridge may also be able to maintain contents fresher longer with less chance for degradation of the flavors, glycerol, or other components which may be part of the substrate, as well as less chance of the contents drying out.

According to embodiments of the present disclosure, there is provided an aerosol generating system comprising a cartridge as above described and an aerosol-generating device. The cartridge may comprise an aerosol-generating substrate disposed in the cartridge. The aerosol-generating device may comprise a receptacle for receiving the cartridge. The aerosol-generating device may comprise a heating element for heating the aerosol-generating substrate when the cartridge is received in the receptacle of the aerosol-generating device.

According to embodiments of the present disclosure, there is provided an aerosol generating system comprising a cartridge as above described and an aerosol-generating device. The cartridge comprises an aerosol-generating substrate disposed in the cartridge. The aerosol-generating device comprises a receptacle for receiving the cartridge. The aerosol-generating device comprises a heating element for heating the aerosol-generating substrate when the cartridge is received in the receptacle of the aerosol-generating device.

According to embodiments of the present disclosure, there is provided a shisha system comprising a cartridge as above described and a shisha device. The cartridge may comprise an aerosol-generating substrate disposed in the cartridge. The shisha device may comprise a receptacle for receiving the cartridge. The shisha device may comprise a heating element for heating the aerosol-generating substrate when the cartridge is received in the receptacle of the shisha device. The shisha device may comprise a vessel having a liquid fill level and defining a head space above the liquid fill level. The shisha device may comprise an aerosol conduit for conveying aerosol from the receptacle to the vessel. The shisha device may comprise an outlet in fluid communication with the head space.

According to embodiments of the present disclosure, there is provided a shisha system comprising a cartridge as above described and a shisha device. The cartridge comprises an aerosol-generating substrate disposed in the cartridge. The shisha device comprises a receptacle for receiving the cartridge. The shisha device comprises a heating element for heating the aerosol-generating substrate when the cartridge is received in the receptacle of the shisha device. The shisha device comprises a vessel having a liquid fill level and defining a head space above the liquid fill level. The shisha device comprises an aerosol conduit for conveying aerosol from the receptacle to the vessel and an outlet in fluid communication with the head space.

In some embodiments where the lid is part of an outer packaging, the apertures in the cartridge may be conveniently formed by removing the cartridge from the outer package. Further, an outer packaging that also functions as the lid saves material and manufacturing costs.

The term "aerosol" is used herein to refer to a suspension of fine solid particles or liquid droplets in a gas, such as air, which may contain volatile flavor compounds.

The term "aerosol-forming substrate" is used herein to refer to a material to be heated to volatilize one or more components of the aerosol-forming substrate to generate an aerosol. The aerosol-forming substrate may be disposed inside the cartridge.

The terms "integral" and "integrally formed" are used herein to describe elements that are formed in one piece (a single, unitary piece) and cannot be separably removed from each other without causing structural damage to the piece.

As used herein, the singular forms "a," "an," and "the" also encompass embodiments having plural referents, unless the content clearly dictates otherwise.

As used herein, "or" is generally employed in its sense including "one or the other or both" unless the content clearly dictates otherwise.

The term "about" is used herein in conjunction with numeric values to include normal variations in measurements as expected by persons skilled in the art, and is understood to have the same meaning as "approximately." The term "about" understood to cover a typical margin of error. A typical margin of error may be, for example, ±5% of the stated value.

As used herein, "have," "having," "include," "including," "comprise," "comprising" or the like are used in their open-ended sense, and generally mean "including, but not limited to". It will be understood that "consisting essentially of," "consisting of," and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

The term "substantially" as used herein has the same meaning as "significantly," and can be understood to modify the term that follows by at least about 90%, at least about 95%, or at least about 98%. The term "not substantially" as used herein has the same meaning as "not significantly," and can be understood to have the inverse meaning of "substantially," i.e., modifying the term that follows by not more than 10%, not more than 5%, or not more than 2%.

The cartridges of the present disclosure may comprise any suitable body defining a cavity. Aerosol-forming substrate may be disposed in the cavity of the cartridge. The body is preferably formed from one or more heat-resistant materials, such as a heat-resistant metal or polymer. The body may comprise a thermally conductive material. For example, the body may comprise any of aluminum, copper, zinc, nickel, silver, any alloys thereof, and combinations thereof. Preferably, the body comprises aluminum. In some embodiments, the body includes a laminated material.

According to an embodiment, the cartridge includes a lid with an inner layer facing the cavity and an outer layer facing the outside of the body of the cartridge. The inner layer has a weakened region. The lid may cover the top or the bottom, or both the top and bottom of the cartridge. When the outer layer is removed, the weakened region of the inner layer forms an aperture. The apertures may function as an inlet, an outlet, or both an inlet and an outlet of the cartridge.

The weakened region can be provided in various shapes and sizes. The weakened region may be made up of a pattern of weakened regions. In some embodiments, the pattern is made up of dots, parallel lines, non-parallel lines, a spiral pattern, or a combination thereof.

The cartridge may be of any suitable shape. For example, the cartridge may have a shape configured to be received by a shisha device. The cartridge may have a substantially cuboidal shape, cylindrical shape, frustoconical shape, or any other suitable shape. Preferably, the cartridge has a generally cylindrical shape or a frustoconical shape.

The cartridge may be used in an aerosol-generating device. The aerosol-generating device may comprise, for example, an aerosol-generating element, power supply, an airflow path with an airflow inlet and airflow outlet, and a receptacle configured to receive the cartridge. The aerosol-generating device may comprise control electronics or other features configured to facilitate the use and/or operation of the device. The aerosol-generating device may be a shisha device. The aerosol-generating element may be a heating element.

The aerosol-generating device (for example, a shisha device) is configured to heat the aerosol-forming substrate in the cartridge. The device may be configured to heat the aerosol-forming substrate in the cartridge by conduction. The cartridge is preferably shaped and sized to allow contact with, or minimize distance from, a heating element of the shisha device to provide efficient heat transfer from the heating element to the aerosol-forming substrate in the cartridge. The heat may be generated by any suitable mechanism, such as by resistive heating or by induction or by infrared heating or by any combination of two or more of: resistive heating, induction heating, and infrared heating. In order to facilitate inductive heating, the cartridge may be provided with a susceptor. For example, the cartridge body may be made from or include a material (for example, aluminum) that is capable of acting as a susceptor, or a susceptor material may be provided within the cavity of the cartridge. A susceptor material may be provided within the cavity of the cartridge in any form, for example a powder, a solid block, shreds, etc.

In order to facilitate infrared heating, in some embodiments, the cartridge may be arranged for being heated by infrared radiation and the cartridge may be arranged for heating the aerosol-forming substrate by conduction. For example, in some embodiments, the cartridge comprises an outer surface comprising a high emissivity material, whilst at least a wall of the cartridge body is made of a thermally conductive material. A high emissivity material may be at least 0.8, preferably at least 0.9. The high emissivity material may be applied as a coating. The high emissivity material may comprise one or more transition metal oxides. The high emissivity material may be selected from one or more of: $Cr_2O_3$, $CoO_x$, $Fe_2O_3$, and NiO. The high emissivity material may be coated on the outer surface of the cartridge. The coating may comprise a refractory pigment and a binder agent. The refractory pigment may be selected from one or more of zirconia, zirconia silicate, aluminum oxide, aluminum silicate and silicon oxide. In this way, a photonic source, for example provided as part of the aerosol-generating device, may generate electromagnetic radiation to heat the high emissivity material to indirectly heat the aerosol-forming substrate in the cartridge.

In order to facilitate infrared heating, in some embodiments, the device may be arranged for heating the aerosol-forming substrate with infrared radiation. The device may comprise a photonic device configured to generate a beam of IR radiation for directing onto the aerosol-forming substrate. In some embodiments, the range of wavelengths of the beam of IR radiation is from 800 nm (nanometers) to 2300 nm, preferably from 1300 nm to 2000 nm. In some embodiments, the diameter of the beam of IR radiation is in the range of from 1 mm (millimeter) to 110 mm, preferably from 2 mm to 100 mm, and more preferably from 5 mm to 80 mm. In some embodiments, the power of the beam of IR radiation is in the range of from 0.1 W to 30 W, preferably from 0.5 W to 25 W, more preferably from 1 W to 20 W, and more preferably from 1 W to 3 W. In some embodiments, the energy density of the beam of IR radiation may be in a range of from 0.010 $W/cm^2$ (Watt per square centimeter) to 30 $W/cm^2$, preferably from 0.050 $W/cm^2$ to 6 $W/cm^2$, and more preferably from 0.100 $W/cm^2$ to 3 $W/cm^2$.

Any suitable aerosol-forming substrate may be provided in the cavity of the cartridge. The aerosol-forming substrate is preferably a substrate capable of releasing volatile compounds. The aerosol-forming substrate is preferably a substrate capable of releasing compounds that may form an aerosol. The volatile compounds may be released by heating the aerosol-forming substrate. The aerosol-forming substrate may be solid or liquid or comprise both solid and liquid components. Preferably, the aerosol-forming substrate is a shisha substrate. A shisha substrate is understood to mean a consumable material that is suitable for use in a shisha device. Shisha substrate may include molasses.

The aerosol-forming substrate may comprise nicotine. The nicotine containing aerosol-forming substrate may comprise a nicotine salt matrix. The aerosol-forming substrate may comprise plant-based material. The aerosol-forming substrate preferably comprises tobacco. The tobacco containing material preferably comprises volatile tobacco flavor compounds, which are released from the aerosol-forming substrate upon heating. The aerosol-forming substrate may comprise homogenized tobacco material. Homogenized tobacco material may be formed by agglomerating particulate tobacco. The aerosol-forming substrate may alternatively or additionally comprise a non-tobacco-containing material. The aerosol-forming substrate may comprise homogenized plant-based material.

The aerosol-forming substrate may include, for example, one or more of: powder, granules, pellets, shreds, spaghettis, strips, or sheets. The aerosol-forming substrate may contain one or more of: herb leaf, tobacco leaf, fragments of tobacco ribs, reconstituted tobacco, homogenized tobacco, extruded tobacco, and expanded tobacco.

The aerosol-forming substrate may include at least one aerosol former. Suitable aerosol formers include compounds or mixtures of compounds which, in use, facilitate formation of a dense and stable aerosol and which are substantially resistant to thermal degradation at the operating temperature of the shisha device. Suitable aerosol formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine. The aerosol-forming substrate may include any suitable amount of an aerosol former. For example, the aerosol former content of the substrate may be equal to or greater than 5% on a dry weight basis, and preferably greater than 30% by weight on a dry weight basis. The aerosol former content may be less than about 95% on a dry weight basis. Preferably, the aerosol former content is up to about 55%.

The aerosol-forming substrate preferably includes nicotine and at least one aerosol former. In some embodiments, the aerosol former is glycerine or a mixture of glycerine and one or more other suitable aerosol formers, such as those listed above.

The aerosol-forming substrate may include other additives and ingredients, such as flavorants, sweeteners, etc. In some examples, the aerosol-forming substrate includes one or more sugars in any suitable amount. Preferably, the aerosol-forming substrate includes invert sugar. Invert sugar is a mixture of glucose and fructose obtained by splitting sucrose. Preferably, the aerosol-forming substrate includes from about 1% to about 40% sugar, such as invert sugar, by weight.

In some example, one or more sugars may be mixed with a suitable carrier such as cornstarch or maltodextrin.

In some examples, the aerosol-forming substrate includes one or more sensory-enhancing agents. Suitable sensory-enhancing agents include flavorants and sensation agents, such as cooling agents. Suitable flavorants include natural or synthetic menthol, peppermint, spearmint, coffee, tea, spices (such as cinnamon, clove, ginger, or combination thereof), cocoa, vanilla, fruit flavors, chocolate, eucalyptus, geranium, eugenol, agave, juniper, anethole, linalool, and any combination thereof.

In some examples, the aerosol-forming substrate is in the form of a suspension. For example, the aerosol-forming substrate may include molasses. As used herein, "molasses" means an aerosol-forming substrate composition comprising about 20% or more sugar. For example, the molasses may include at least about 25% by weight sugar, such as at least about 35% by weight sugar. Typically, the molasses will contain less than about 60% by weight sugar, such as less than about 50% by weight sugar.

Any suitable amount of aerosol-forming substrate (for example, molasses or tobacco substrate) may be disposed in the cavity. In some preferred embodiments, about 3 g to about 25 g of the aerosol-forming substrate is disposed in the cavity. The cartridge may include at least 6 g, at least 7 g, at least 8 g, or at least 9 g of aerosol-forming substrate. The cartridge may include up to 15 g, up to 12 g; up to 11 g, or up to 10 g of aerosol-forming substrate. Preferably, from about 7 g to about 13 g of aerosol-forming substrate is disposed in the cavity.

The aerosol-forming substrate may be provided on or embedded in a thermally stable carrier. The term "thermally stable" is used herein to indicate a material that does not substantially degrade at temperatures to which the substrate is typically heated (e.g., about 150° C. to about 300° C.). The carrier may comprise a thin layer on which the substrate deposited on a first major surface, on second major outer surface, or on both the first and second major surfaces. The carrier may be formed of, for example, a paper, or paper-like material, a non-woven carbon fiber mat, a low mass open mesh metallic screen, or a perforated metallic foil or any other thermally stable polymer matrix. Alternatively, the carrier may take the form of powder, granules, pellets, shreds, spaghettis, strips or sheets. The carrier may be a non-woven fabric or fiber bundle into which tobacco components have been incorporated. The non-woven fabric or fiber bundle may comprise, for example, carbon fibers, natural cellulose fibers, or cellulose-derivative fibers.

The body of the cartridge may include one or more walls. In some embodiments, the body includes a top wall, a bottom wall, and a sidewall. In some embodiments, the lid forms the top wall, the bottom wall, or both the top and bottom walls. The sidewall may be cylindrical or frustoconical, extending from the bottom to the top. The body may include one or more parts. For example, the sidewall and the bottom wall may be an integral single part. The sidewall and the bottom wall may be two parts configured to engage one another in any suitable manner. For example, the sidewall and the bottom wall may be configured to engage one another by threaded engagement or interference fit. The sidewall and the bottom wall may be two parts joined together. For example, the sidewall and the bottom wall may be joined together by welding or by an adhesive. The top wall and sidewall may be a single integral part. The sidewall and the top wall may be two parts configured to engage one another in any suitable manner. For example, sidewall and the top wall may be configured to engage one another by threaded engagement or interference fit. The sidewall and the top wall may be two parts joined together. For example, the sidewall and the top wall may be joined together by welding or by an adhesive. The top wall, sidewall and bottom wall may all be a single integral part. The top wall, the sidewall, and the bottom wall may be three separate parts configured to engage one another in any suitable manner. For example, the top wall, the sidewall, and the bottom wall may be configured to engage by threaded engagement interference fit, welding, or an adhesive.

One or more walls of the body may form a heatable wall or surface. As used herein, "heatable wall" and "heatable surface" mean an area of a wall or a surface to which heat may be applied, either directly or indirectly. The heatable wall or surface may function as a heat transfer surface through which heat may be transferred from outside of the body to the cavity or to an internal surface of the cavity.

Preferably, the body of the cartridge has a length (for example, an axial length along a vertical center axis) of about 15 cm or less. In some embodiments, the body has a length of about 10 cm or less. The body may have an inside diameter of about 1 cm or more. The inside diameter of the body may be about 1.75 cm or more. The cartridge may have a heatable surface area in the cavity from about 25 $cm^2$ to about 100 $cm^2$, such as from about 70 $cm^2$ to about 100 $cm^2$. The volume of the cavity may be from about 10 $cm^3$ to about 50 $cm^3$; preferably from about 25 $cm^3$ to about 40 $cm^3$. In some embodiments, the body has a length in a range from about 3.5 cm to about 7 cm. The inside diameter of the body may be from about 1.5 cm to about 4 cm. The body may have a heatable surface area in the cavity from about 30 $cm^2$ to about 100 $cm^2$, such as from about 70 $cm^2$ to about 100 $cm^2$. The volume of the cavity may be from about 10 $cm^3$ to about 50 $cm^3$; preferably from about 25 $cm^3$ to about 40 $cm^3$. Preferably, the body is cylindrical or frustoconical.

According to an embodiment, the cartridge includes a lid with an inner layer facing the cavity and an outer layer facing the outside of the body of the cartridge. The inner layer has a weakened region that may form an aperture when the outer layer is removed. The walls of the body may be made from one or more materials. The inner and outer layers of the lid may be made from the same, similar, or different materials than the walls of the body. The body may include one or more heat-resistant materials, such as a heat-resistant metal or polymer. For example, the body may comprise any of aluminum, copper, zinc, nickel, silver, any alloys thereof, and combinations thereof. The body may also include one or more heat-deformable materials, such as a heat-deformable polymer or other material capable of changing its shape at a threshold temperature. In some embodiments, the body includes a laminated material or a plurality of layers including two or more materials.

The apertures, including the formed aperture and other optional apertures of the cartridge, may provide an opening or ventilation hole through one or more walls of the body. The ventilation holes may be inlets, outlets, or both. The ventilation holes may be disposed at the bottom wall, top wall, sides, or a combination thereof, of the cartridge. In some embodiments, the ventilation holes (for example, one or more inlets and one or more outlets) are formed when the outer layer of the lid is removed to allow air to flow through the aerosol-forming substrate when the cartridge is used with a shisha device.

The size of the apertures formed in the weakened region after removal of the outer layer may be selected to result in a desired resistance to draw (RTD) through the cartridge. For example, the weakened region may cover 5% or greater, 10% or greater, 15% or greater, 20% or greater, 25% or greater, 30% or greater of the lid surface area; or 50% or less, 45% or less, 40% or less, 35% or less, 30% or less, 25% or less, or 20% or less of the lid surface area. In one embodiment, the weakened region (or the apertures formed in the weakened region) may cover about 30% of the lid surface area.

The cartridge may include additional openings or in some embodiments, an absent top wall, to form one or more additional ventilation holes in the cartridge. The additional openings may be covered by a peelable label of sticker, foil, or the like. The cartridge may also include a pierceable wall. The pierceable wall may be pierced to form openings using the shisha device or an accessory.

Preferably, the one or more inlets and outlets, once formed or opened, are sized and shaped to provide a suitable resistance to draw (RTD) through the cartridge. In some examples, the RTD through the cartridge, from the inlet or inlets to the outlet or outlets, may be from about 10 mm $H_2O$ to about 50 mm $H_2O$, preferably from about 20 mm $H_2O$ to about 40 mm $H_2O$. The RTD of a specimen refers to the static pressure difference between the two ends of the specimen when it is traversed by an air flow under steady conditions in which the volumetric flow is 17.5 milliliters per second at the output end. The RTD of a specimen may be measured using the method set out in ISO Standard 6565:2002.

The one or more openings on the body, once formed or opened, may cover 5% or greater, 10% or greater, 15% or greater, 20% or greater, or 25% or greater of the area of the wall the openings are on. For example, if the openings are on the top wall, the openings may cover at least 5% of the area of the top wall. The one or more openings on the body may cover 75% or less, 50% or less, 40% or less, or 30% or less of the area of the wall the openings are on.

The cartridge may include a removable seal or film covering the one or more inlets or outlets prior to use. The removable seal or film is preferably sufficient to prevent air flow through the inlets and outlets to prevent leakage of the contents of the cartridge and to extend shelf life. The removable seal or film may comprise a peelable label of sticker, foil, or the like. The label, sticker, or foil may be affixed to the cartridge in any suitable manner, such as with an adhesive, crimping, welding, or otherwise being joined to the container. The removable seal or film may comprise a tab that may be grasped to peel or remove the label, sticker, or foil from the cartridge.

The inner layer of the lid may be constructed from any suitable material. For example, the inner layer may include polymeric material, metal, paper, or a combination thereof. In one embodiment, the inner layer comprises metal foil. In one embodiment, the inner layer comprises polymeric foil. The inner layer may have any suitable thickness. For example, the inner layer may have a thickness of 20 μm or greater, 50 μm or greater, 100 μm or greater, or 200 μm or greater. The inner layer may have a thickness of 1 mm or less, 750 μm or less, or 500 μm or less. The thickness of the inner layer may vary across the lid. For example, the thickness of the inner layer at the weakened region may be less than in areas outside of the weakened region.

The inner and outer layers of the lid may be bonded together. For example, the inner and outer layers of the lid may be bonded together by a bonding layer. The bonding layer may comprise, for example, an adhesive, solder, or other join capable of bonding the inner and outer layers together.

The weakened region may be provided or formed by any suitable technique. For example, the weakened region may be provided or formed by scoring, cutting, or laser cutting the inner layer. The scoring, cutting, or laser cutting may result in a partial cut. The weakened region may be provided or formed by pressing or embossing an area of the inner side of the lid. The pressing may cause a thinner (frangible) region of the inner layer to form. The inner and outer layers may be first laminated together. The pressing may cause a portion of the inner layer to be compressed into the outer layer. Removal of the outer layer from the cartridge may cause the portion compressed into the outer layer to be removed, forming an aperture in the inner layer. In another example, the weakened region may be provided or formed by etching the inner layer. The etching may cause a thinner (frangible) region of the inner layer to form. The weakened region may be provided or formed by providing a weaker or more frangible material as compared to the surrounding area.

In some embodiments, the material of the inner layer is frangible. When a force (such as pulling or tearing) is applied to the frangible material, a mechanical failure occurs, causing one or more apertures to form. Outside of the weakened area, the frangible material may be supported, for example, by bonding to the outer layer. In one example, a bonding layer is provided in one area and no bonding layer is provided in the surrounding area, such that a weakened region is formed between the bonded and non-bonded areas. The bonding layer may, for example, bond the inner layer and the outer layer together. The bonding layer may comprise, for example, an adhesive, solder, or other join capable of bonding the inner and outer layers together. The material of the inner layer may be frangible due to its thickness (for example, a thin layer of plastic) or its material properties (for example, aluminum foil or paper), or both thickness and material properties.

The outer layer may include any suitable material. For example, the outer layer may include polymeric material, metal, paper, cardboard, or a combination thereof. In one embodiment, the outer layer comprises cardboard. In one embodiment, the outer layer comprises metal. In one embodiment, the outer layer comprises polymeric material. The outer layer may have any suitable thickness. For example, the outer layer may have a thickness of 20 μm or greater, 100 μm or greater, 500 μm or greater, or 1 mm or greater. The outer layer may have a thickness of 5 mm or less, 4 mm or less, 3 mm or less, 2 mm or less, or 1 mm or less.

In one embodiment, the outer layer comprises cardboard and the inner layer comprises metal foil. In one embodiment, the outer layer comprises cardboard and the inner layer comprises polymeric film. In one embodiment, the outer layer comprises cardboard and the inner layer comprises paper. In one embodiment, the outer layer comprises metal and the inner layer comprises metal foil. In one embodiment, the outer layer comprises metal and the inner layer comprises polymeric film. In one embodiment, the outer layer comprises polymeric material and the inner layer comprises metal foil or polymeric film. The outer layer and the inner layer may be bonded together by a bonding layer.

The outer layer maybe constructed so that it can be removed (for example, pulled, peeled, or torn) from the cartridge without tools. Preferably, the outer layer is constructed so that removing the outer layer also removes a portion of the inner layer. The inner layer may break off (for example, exhibit mechanical failure) along one or more edges of the weakened portion. The inner layer may break off along a line of breakage defined by the weakened portion. According to some embodiments, removing of the outer layer and breaking off of at least a portion of the inner layer causes one or more apertures to form in the cartridge.

The lid or the outer layer may include features that facilitate removal of the outer layer. For example, the lid or the outer layer may comprise a pull tab.

In some embodiments, the outer layer may be part of an outer packaging. In some embodiments, the outer layer may be integral with an outer packaging. The outer layer may include text, images, logos, branding, or other insignia. The outer packaging may at least partially surround the body of the cartridge. For example, the outer packaging may surround or cover the top, the bottom, or both the top and the bottom of the cartridge. The outer packaging may surround or cover the top and at least one side of the body, the bottom and at least one side of the body, or the top and the bottom and at least one side of the body. When the cartridge is removed from the outer packaging, the outer layer is removed from the body and an aperture is formed on the inner layer. In some embodiments, when the cartridge is removed from the outer packaging, the cartridge body becomes separated from the packaging while the outer layer remains attached to the packaging and an aperture is formed on the inner layer. The outer layer may be part of an outer packaging that at least partially surrounds a plurality of cartridges. The outer packaging may form a connected top, a connected bottom, or both a connected top and bottom for a plurality of cartridges. The connected top or bottom may refer to a top or bottom spanning over the inner layer of multiple cartridges. For example, the outer layer may be part of an outer packaging that houses two or more, three or more, or four or more cartridges. The outer layer may be part of an outer packaging that houses up to six, up to eight, or up to ten cartridges. In some embodiments, the outer layer may be part of an outer packaging that houses four cartridges. When the cartridge is removed from the outer packaging, the cartridge body becomes separated from the packaging. The portion of the packaging that forms the outer layer on the cartridge being removed may become separated from the cartridge body and the inner layer, and remain as part of the packaging. Alternatively, the portion of the packaging that forms the outer layer on the cartridge being removed may become separated from the rest of the packaging and remain on the cartridge body. The remaining outer layer may then be removed later from the cartridge body to form apertures in the weakened region of the inner layer.

In some embodiments the cartridge is a shisha cartridge that may be used with any suitable shisha device. Preferably, the shisha device is configured to sufficiently heat the aerosol-forming substrate in the cartridge to form an aerosol from the aerosol-forming substrate but not to combust the aerosol-forming substrate. For example, the shisha device may be configured to heat the aerosol-forming substrate to a temperature in a range from about 150° C. to about 300° C.; more preferably from about 180° C. to about 250° C. or from about 200° C. to about 230° C.

The shisha device may include a receptacle for receiving the cartridge. The shisha device may include a heating element configured to contact or to be in proximity to the body of the cartridge when the cartridge is received in the receptacle. The heating element may form at least part of the receptacle. For example, the heating element may form at least a portion of the surface of the receptacle. The shisha cartridge may be configured to transfer heat from the heating element to the aerosol-forming substrate in the cavity by conduction. In some embodiments, the heating element includes an electric heating element. In some embodiments, the heating element includes a resistive heating component. For example, the heating element may include one or more resistive wires or other resistive elements. The resistive wires may be in contact with a thermally conductive material to distribute heat produced over a broader area. Examples of suitable conductive materials include aluminum, copper, zinc, nickel, silver, and combinations thereof. The heating element may form at least a portion of the surface of the receptacle.

The shisha device may include control electronics operably coupled to the heating element. The control electronics may be configured to control heating of the heating element. The control electronics may be configured to control the temperature to which the aerosol-forming substrate in the cartridge is heated. The control electronics may be provided in any suitable form and may, for example, include a controller or a memory and a controller. The controller may include one or more of an Application Specific Integrated Circuit (ASIC) state machine, a digital signal processor, a gate array, a microprocessor, or equivalent discrete or integrated logic circuitry. Control electronics may include memory that contains instructions that cause one or more components of the circuitry to carry out a function or aspect of the control electronics. Functions attributable to control electronics in this disclosure may be embodied as one or more of software, firmware, and hardware.

The electronic circuitry may include a microprocessor, which may be a programmable microprocessor. The electronic circuitry may be configured to regulate a supply of power. The power may be supplied to the heater element in the form of pulses of electrical current.

In some examples, the control electronics may be configured to monitor the electrical resistance of the heating element and to control the supply of power to the heating element depending on the electrical resistance of the heating element. In this manner, the control electronics may regulate the temperature of the resistive element.

The shisha device may include a temperature sensor, such as a thermocouple. The temperature sensor may be operably coupled to the control electronics to control the temperature of the heating element. The temperature sensor may be positioned in any suitable location. For example, the temperature sensor may be configured to insert into the cartridge when received within the receptacle to monitor the temperature of the aerosol-forming substrate being heated. In addition or alternatively, the temperature sensor may be in contact with the heating element. In addition or alternatively, the temperature sensor may be positioned to detect temperature at an aerosol outlet of the shisha device or a portion thereof. The sensor may transmit signals regarding the sensed temperature to the control electronics. The control electronics may adjust heating of the heating elements in response to the signal to achieve a suitable temperature at the sensor.

The control electronics may be operably coupled to a power supply. The shisha device may include any suitable power supply. For example, a power supply of a shisha device may be a battery or set of batteries. The batteries of the power supply may be rechargeable, removable and replaceable, or rechargeable and removable and replaceable. Any suitable battery may be used. For example, heavy duty type or standard batteries existing in the market, such as used for industrial heavy-duty electrical power-tools. Alternatively, the power supply may be any type of electric power supply including a super or hyper-capacitor. Alternatively, the assembly may be connected to an external electrical power source, and electrically and electronically designed for such purpose. Regardless of the type of power supply employed, the power supply preferably provides sufficient energy for the normal functioning of the assembly for at least one shisha session until aerosol is depleted from the aerosol-forming substrate in the cartridge before being recharged or needing to connect to an external electrical power source. Preferably, the power supply provides sufficient energy for the normal functioning of the assembly for at least about 70 minutes of continuous operation of the device, before being recharged or needing to connect to an external electrical power source.

In one example, a shisha device includes an aerosol-generating element that includes a cartridge receptacle, a heating element, an aerosol outlet, and a fresh air inlet. The cartridge receptacle is configured to receive a cartridge according to the present disclosure containing the aerosol-forming substrate. The heating element may define at least part of a surface of the receptacle.

The shisha device includes a fresh air inlet channel in fluid connection with the receptacle. In use, when the substrate inside the cartridge is heated, aerosol former components in the substrate vaporize. Air flowing from the fresh air inlet channel through the cartridge becomes entrained with aerosol generated from the aerosol former components in the cartridge.

Some electrically heated shisha devices employ preheated air and typically employ an airflow path such that the air travels in the vicinity of the heat source upon puffing. Further, some electrically heated shisha devices employ elements that increase radiation heat transfer by increasing the heated surface area.

The fresh air inlet channel may include one or more apertures through the cartridge receptacle such that fresh air from outside the shisha device may flow through the channel and into the cartridge receptacle through the one or more apertures. If a channel includes more than one aperture, the channel may include a manifold to direct air flowing through the channel to each aperture. Preferably, the shisha device includes two or more fresh air inlet channels.

As described above, the cartridge includes one or more openings (such as inlets or outlets) formed in the body, allowing air to flow through the cartridge. If the receptacle includes one or more inlet apertures, at least some of the inlets in the cartridge may align with the apertures in the top of the receptacle. The cartridge may include an alignment feature configured to mate with a complementary alignment feature of the receptacle to align the inlets of the cartridge with the apertures of the receptacle when the cartridge is inserted into the receptacle.

Air that enters the cartridge may flow across or through, or both across and through the aerosol-forming substrate, entraining aerosol, and exiting the cartridge and receptacle via an aerosol outlet. From the aerosol outlet, the air carrying the aerosol enters a vessel of the shisha device.

The shisha device may include any suitable vessel defining an interior volume configured to contain a liquid and defining an outlet in the headspace above a liquid fill level. The vessel may include an optically transparent or opaque housing to allow a consumer to observe contents contained in the vessel. The vessel may include a liquid fill demarcation, such as a liquid fill line. The vessel housing may be formed of any suitable material. For example, the vessel housing may include glass or suitable rigid plastic material. Preferably, the vessel is removable from a portion of the shisha assembly comprising the aerosol-generating element to allow a consumer to fill, empty or clean the vessel.

The vessel may be filled to a liquid fill level by a consumer. The liquid preferably includes water, which may optionally be infused with one or more colorants, flavorants, or colorants and flavorants. For example, the water may be infused with one or both of botanical and herbal infusions.

Aerosol entrained in air exiting the aerosol outlet of the receptacle may travel through a conduit positioned in the vessel. The conduit may be coupled to the aerosol outlet of the aerosol-generating element and may have an opening below the liquid fill level of the vessel, such that aerosol flowing through the vessel flows through the opening of the conduit, then through the liquid, into headspace of the vessel and exits through a headspace outlet, for delivery to a consumer.

The headspace outlet may be coupled to a hose comprising a mouthpiece for delivering the aerosol to a consumer. The mouthpiece may include an activation element, such as a switch activatable by a user, a puff sensor arranged to detect a user puffing on the mouthpiece, or both a switch activatable by the user and a puff sensor. The activation element is operably coupled to the control electronics of the shisha device. The activation element may be wirelessly coupled to the control electronics. Activation of the activation element may cause the control electronics to activate the heating element, rather than constantly supplying energy to the heating element. Accordingly, the use of an activation element may serve to save energy relative to devices not employing such elements to provide on-demand heating rather than constant heating.

For purposes of example, one method for using a shisha device as described herein is provided below in chronological order. The vessel may be detached from other components of the shisha device and filled with water. One or more of natural fruit juices, botanicals, and herbal infusions may be added to the water for flavoring. The amount of liquid added should cover a portion of the conduit but should not exceed a fill level mark that may optionally exist on the vessel. The vessel is then reassembled to the shisha device. The cartridge may be prepared by removing the outer layer of the lid and any removable film (if present). A portion of the aerosol-generating element may be removed or opened to allow the cartridge to be inserted into the receptacle. The aerosol-generating element is then reassembled or closed. The device may then be turned on. Turning on the device may initiate a heating profile of a heating element, to heat the aerosol-forming substrate to a temperature at or above a vaporization temperature but below a combustion temperature of the aerosol-forming substrate. The aerosol forming compounds of the aerosol-forming substrate vaporize, generating an aerosol. The user may puff on the mouthpiece as desired. The user may continue using the device as long as desired or until no more aerosol is visible or being delivered. In some embodiments, the device may be arranged to automatically shut off when the cartridge or a compartment of the cartridge is depleted of usable aerosol-forming substrate. In some embodiments, the consumer may refill the device with a fresh cartridge after, for example, receiving the cue from the device that the aerosol-forming substrate in the cartridge is depleted or nearly depleted. The shisha device may be turned off at any time by a consumer by, for example, switching off the device.

The shisha device may have any suitable air management. In one example, puffing action from the user will create a suction effect causing a low pressure inside the device which will cause external air to flow through an air inlet of the device, into the fresh air inlet channel, and into the receptacle. The air may then flow through the cartridge in the receptacle and become entrained with aerosol produced from the aerosol-forming substrate. The air with entrained aerosol then exits the aerosol outlet of the receptacle, flows through the conduit to the liquid inside the vessel. The aerosol will then bubble out of the liquid and into head space in the vessel above the level of the liquid, out the headspace outlet, and through the hose and mouthpiece for delivery to the consumer. The flow of external air and the flow of the aerosol inside the shisha device may be driven by the action of puffing from the user.

Reference will now be made to the drawings, which depict one or more embodiments described in this disclosure. However, it will be understood that other embodiments not depicted in the drawings fall within the scope and spirit of this disclosure. Like numbers used in the figures refer to like components. The use of different numbers to refer to components in different figures is not intended to indicate that the different numbered components cannot be the same or similar to other numbered components. The figures are presented for purposes of illustration and not limitation. Schematic drawings presented in the figures are not necessarily to scale.

Figure 1:
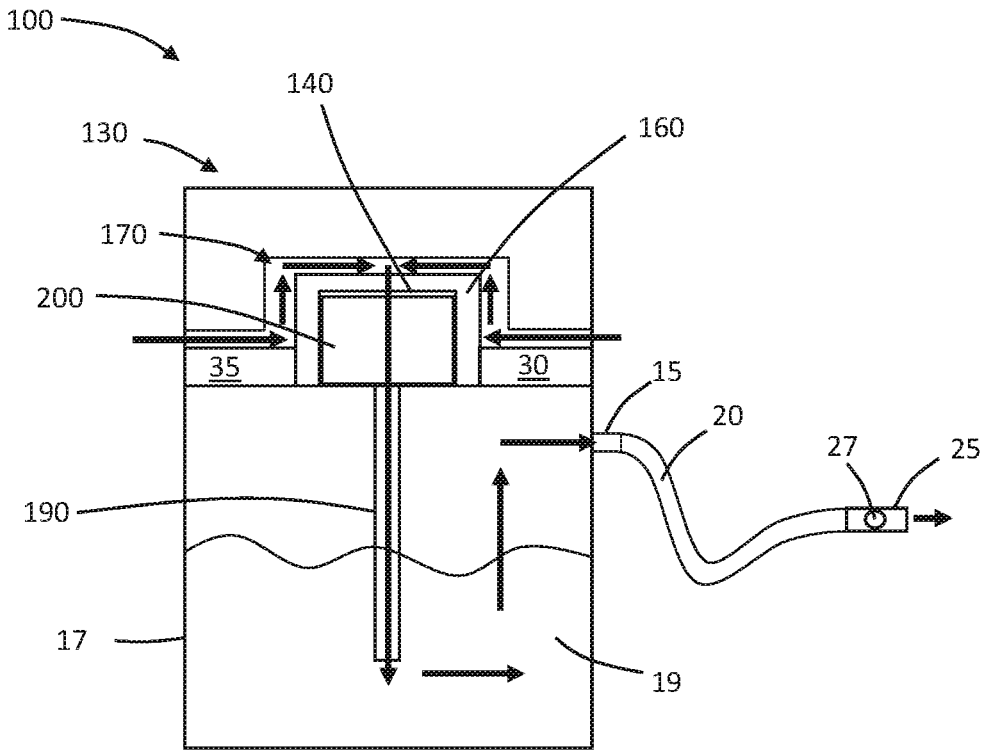
FIG. 1 is a schematic view of a shisha device.

FIG. 1 is a schematic sectional view of an example of a shisha device 100. The device 100 includes a vessel 17 defining an interior volume configured to contain liquid 19 and defining a headspace outlet 15 above a fill level for the liquid 19. The liquid 19 preferably includes water, which may optionally be infused with one or more colorants, one or more flavorants, or one or more colorants and one or more flavorants. For example, the water may be infused with one or both of botanical infusions and herbal infusions.

The device 100 also includes an aerosol-generating element 130. The aerosol-generating element 130 includes a receptacle 140 configured to receive a cartridge 200 comprising an aerosol-forming substrate. The aerosol-generating element 130 may also include a heating element 160. The heating element 160 may form at least one surface of the receptacle 140. In the depicted embodiment, the heating element 160 defines the side surfaces of the receptacle 140. The aerosol-generating element 130 also includes a fresh air inlet channel 170 that draws fresh air into the device 100. In some embodiments, portion of the fresh air inlet channel 170 is formed by the heating element 160 to heat the air before the air enters the receptacle 140. The pre-heated air then enters the cartridge 200, which is also heated by heating element 160, to carry aerosol generated by the aerosol former and the aerosol-forming substrate. The air exits an outlet of the aerosol-generating element 130 and enters a conduit 190.

The conduit 190 carries the air and aerosol into the vessel 17 below the level of the liquid 19. The air and aerosol may bubble through the liquid 19 and exit the headspace outlet 15 of the vessel 17. A hose 20 may be attached to the headspace outlet 15 to carry the aerosol to the mouth of a user. A mouthpiece 25 may be attached to, or form a part of, the hose 20.

An exemplary air flow path of the device, in use, is depicted by thick arrows in FIG. 1.

The mouthpiece 25 may include an activation element 27. The activation element 27 may be a switch, button or the like, or may be a puff sensor or the like. The activation element 27 may be placed at any other suitable location of the device 100. The activation element 27 may be in wireless communication with the control electronics 30 to place the device 100 in condition for use or to cause control electronics to activate the heating element 160; for example, by causing power supply 35 to energize the heating element 160.

The control electronics 30 and power supply 35 may be located in any suitable position of the aerosol-generating element 130, including locations other than the bottom portion of the element 130 as depicted in FIG. 1.

Figure 2A:
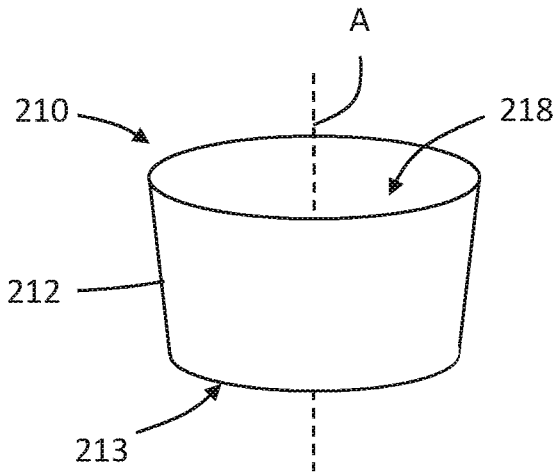
FIGS. 2A and 2B are schematic top and bottom perspective views, respectively, of the body of a shisha cartridge for use in the shisha device of FIG. 1 according to an embodiment.
Figure 2B:
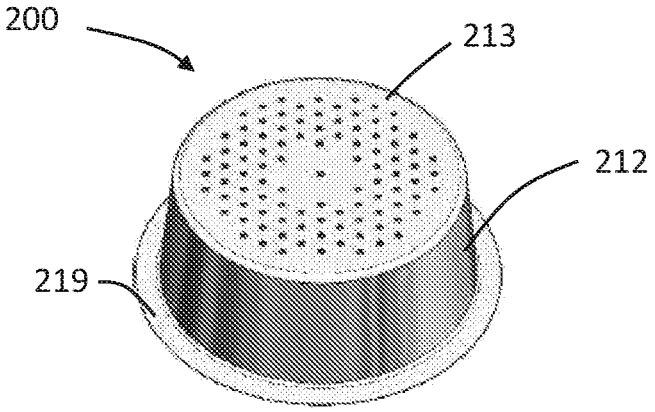

Referring now to FIGS. 2A and 2B, schematic depictions of the body 210 are shown. The body 210 may include a side wall 212, a top wall 215, and a bottom wall 213 defining a cavity 218. The side wall 212 may be cylindrical or frusto-conical, as shown. FIG. 2A shows the body 210 without a top, showing the cavity 218 inside the body. The body 210 may define a center axis A extending through the body 210. The top may comprise a flange 219 that extends from the sidewall 212 as shown in FIG. 2B. The flange 219 may rest on shoulder of a receptacle of a shisha device so that cartridge 200 may be readily removed from the receptacle after use by grasping the flange.

Figure 3A:
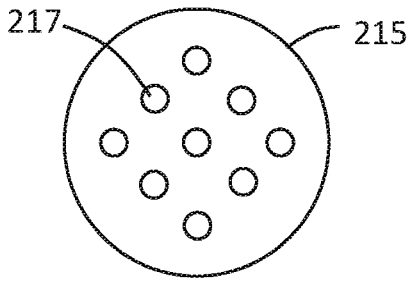
FIGS. 3A and 3B are schematic bottom and top views of a cartridge.
Figure 3B:
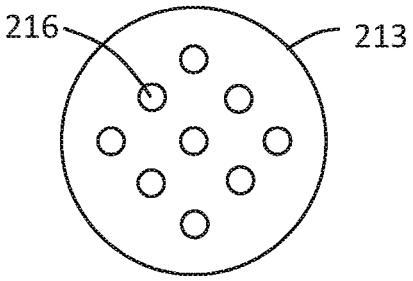

Referring now to FIGS. 3A and 3B, the top 215 and bottom 213 of the body may generally have a plurality of apertures 217, 216 to allow air flow through the cartridge when the cartridge is in use. According to some embodiments, the apertures are present when the cartridge is in an open state. The apertures 216, 217 of the top 215 and bottom 213 may be aligned with each other. The cartridge 200 may also or alternatively include apertures along the sidewall 212. The apertures 217, 216 may be blocked by an outer layer of the lid or by a peelable seal or liner when the cartridge is stored prior to use.

Figure 4A:
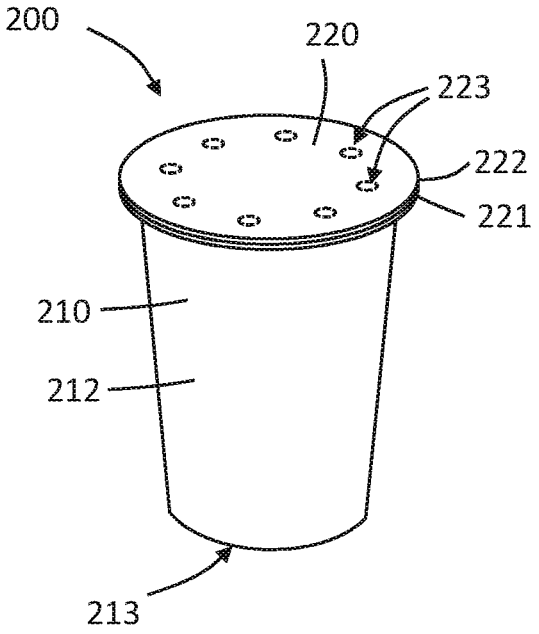
FIGS. 4A and 4B are schematic perspective views of a cartridge in a closed state and an open state, respectively, according to an embodiment.
Figure 4B:
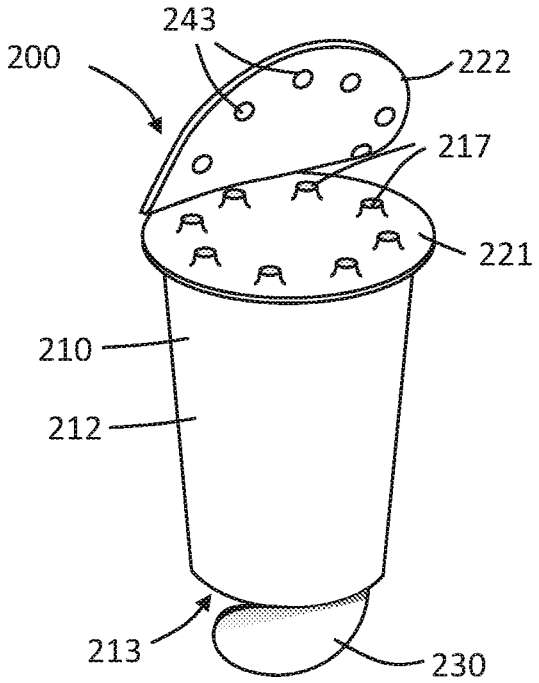

FIGS. 4A and 4B depict schematic perspective views of a cartridge 200 according to an embodiment. In FIG. 4A, the cartridge 200 is in a closed state. The cartridge 200 includes a lid 220 with an inner layer 221 facing the cavity 118 and an outer layer 222 facing the outside of the body 210 of the cartridge 200. The inner layer 221 has a weakened region 223, or a plurality of weakened regions 223, as shown. The lid 220 can cover the top, as shown, or the bottom, or both the top and bottom of the cartridge 200. When the outer layer 222 is removed as shown in FIG. 4B, the weakened regions 223 of the inner layer 221 form apertures 217 and the cartridge 200 is in an open state. The apertures 217 provide fluid communication between the cavity 118 inside the body 210 and the exterior or the cartridge 200. The apertures 217 may function as an inlet, an outlet, or both an inlet and an outlet of the cartridge 200. The cartridge 200 may additionally include a peelable film 230 or sticker covering pre-made openings 216 at the bottom (or at any wall that does not include the lid).

Figure 5A:
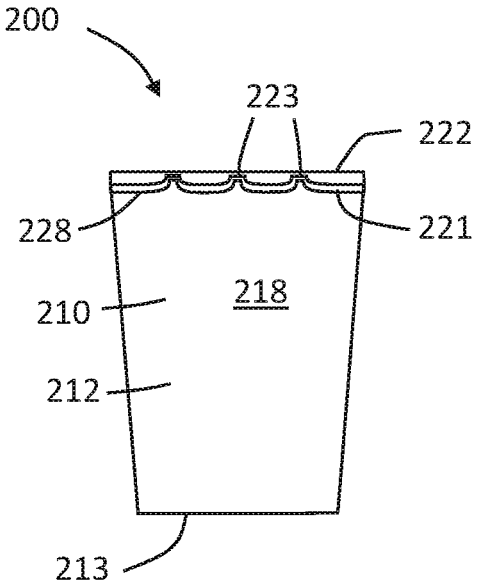
FIGS. 5A and 5B are schematic cross-sectional views of a cartridge in a closed state and an open state, respectively, according to an embodiment.
Figure 5B:
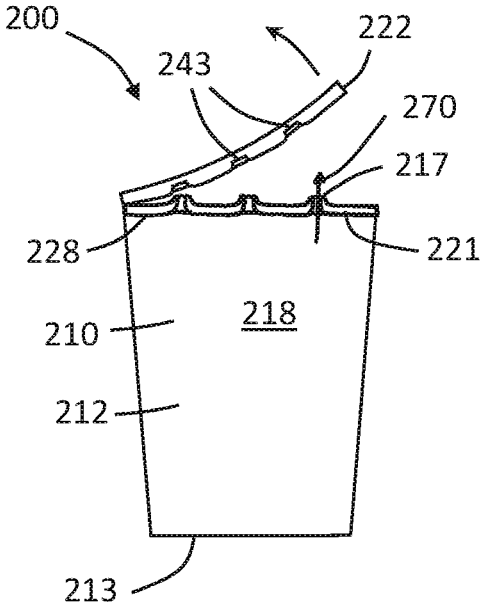

FIGS. 5A-7B show various examples of weakened regions and apertures. Referring now to FIG. 5A, the weakened regions 223 may be provided or formed by pressing or embossing an area of the inner side 228 of the lid 220. The inner and outer layers 221, 222 may be first laminated together. The pressing may cause a thinner (frangible) region of the inner layer 221 to form. The pressing may cause a portion of the inner layer 221 to be compressed into the outer layer 222, as shown. Removal of the outer layer 222 from the cartridge may cause the portion compressed into the outer layer to be removed (removed portion 243), forming an aperture 217 in the inner layer 221, as shown in FIG. 5B. The apertures 217 allow airflow 270 through the wall (in this case, through the inner layer 221 of the lid 220) of the cartridge 220. The apertures 217 provide fluid communication between the cavity 118 inside the body 210 and the exterior or the cartridge 200.

Figure 6A:
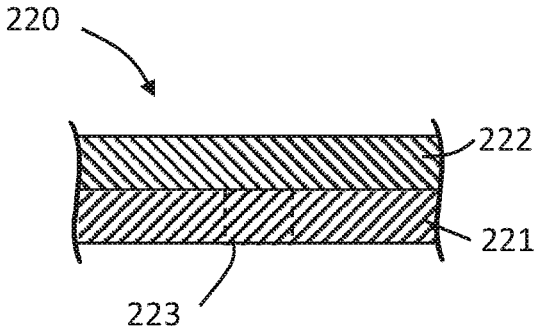
FIGS. 6A and 6B are partial cross-sectional views of a lid of a cartridge in a closed state and an open state, respectively, according to an embodiment.
Figure 6B:
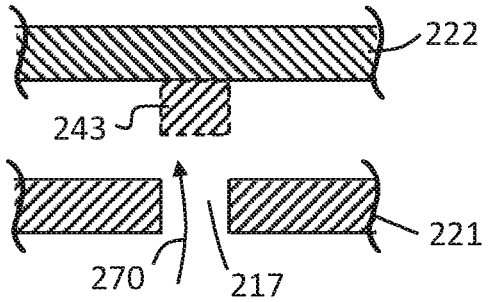

FIGS. 6A and 6B show partial cross-sectional views of a lid, where the weakened region 223 has been provided or formed by scoring, cutting, or laser cutting the inner layer 221. The scoring, cutting, or laser cutting may result in a partial cut. When the outer layer 222 is removed as shown in FIG. 6B, a portion 243 of the inner layer 221 at the weakened region 223 may be removed with the outer layer 222, resulting in the formation of an aperture 217. The lid 220 may include an adhesive between the inner layer 221 and the outer layer 222. The lid 220 may include an adhesive in the area of the weakened region 223.

Figure 7A:
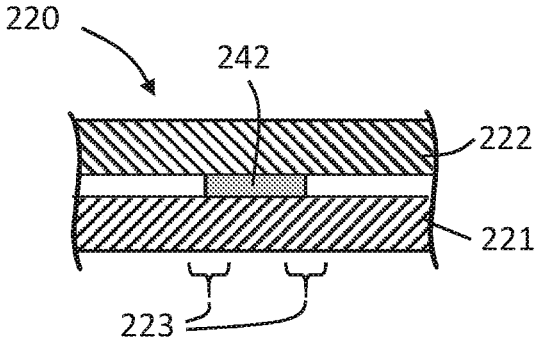
FIGS. 7A and 7B are partial cross-sectional views of a lid of a cartridge in a closed state and an open state, respectively, according to an embodiment.
Figure 7B:
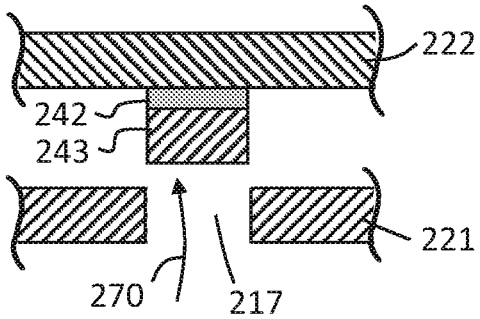

In some embodiments, shown in FIGS. 7A and 7B, the weakened region 223 has been provided or formed by applying an adhesive 242 in some areas and not applying the adhesive in other areas. Weakened regions 223 may be formed in the areas adjacent the adhesive 242. The inner layer 221 may be made from a weaker material (for example, aluminum foil) than the outer layer 222 to facilitate breakage of the inner layer 221 at the weakened regions 223. When the outer layer 222 is removed as shown in FIG. 7B, a portion 243 of the inner layer 221 at the weakened region 223 may be removed with the outer layer 222, resulting in the formation of an aperture 217.

Figure 8:
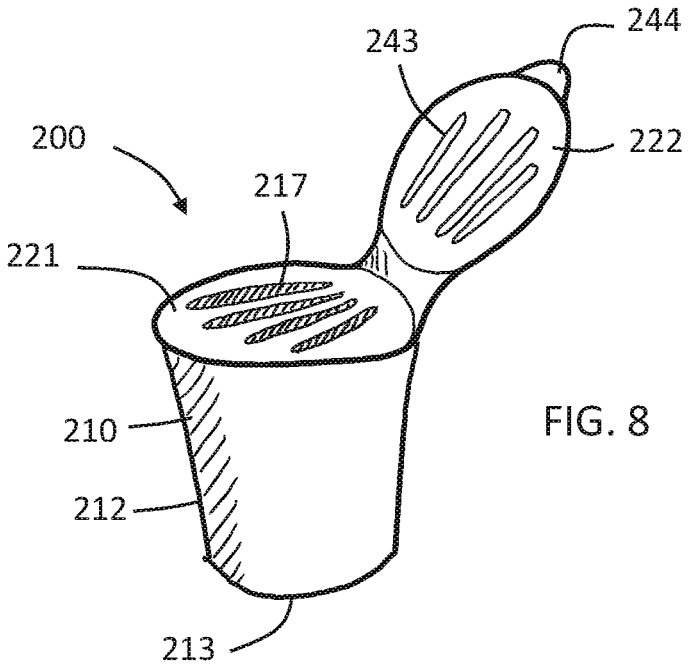
FIG. 8 is a schematic perspective view of a cartridge in an open state according to an embodiment.

Referring now to FIG. 8, the outer layer 222 of the lid 220 may be attached to the cartridge 200 so that when the lid is opened (when the outer layer 222 is removed), the outer layer 222 remains attached. The outer layer 222 may include a tab 244 to facilitate pulling, peeling, or tearing the outer layer 222 off. The cartridge may include with slot-shaped weakened regions 223 and apertures 217.

Figure 9A:
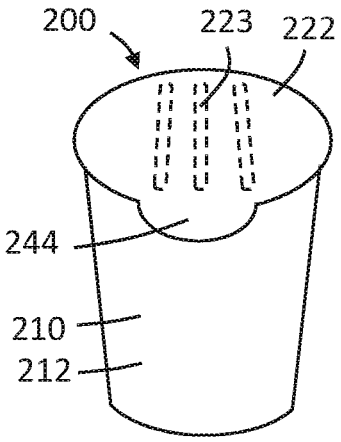
FIGS. 9A and 9B are schematic perspective views of a cartridge in a closed state and an open state, respectively, according to an embodiment.
Figure 9B:
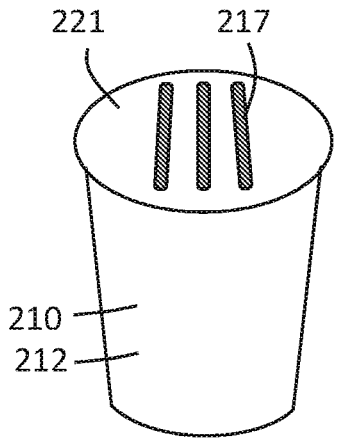

The weakened region 223 may be provided in any suitable shape. The weakened region 223 and the resulting aperture (s) 217 may comprise a plurality of dots, as shown in FIGS. 4A and 4B, or one or more lines or slots, as shown in FIGS. 9A and 9B. The lines or slots of the weakened region 223 and the resulting aperture(s) 217 may be substantially parallel.

Figure 10A:
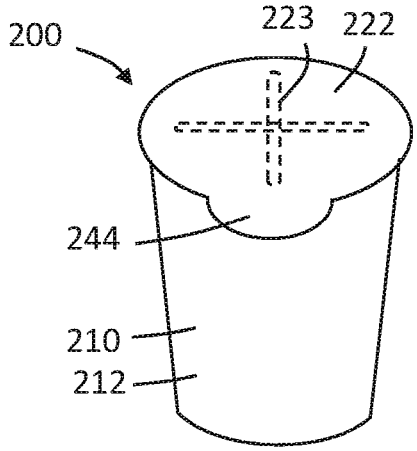
FIGS. 10A and 10B are schematic perspective views of a cartridge in a closed state and an open state, respectively, according to an embodiment.
Figure 10B:
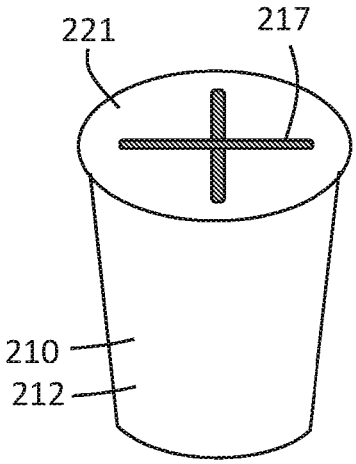

In one exemplary embodiment shown in FIGS. 10A and 10B, the weakened region 223 and the resulting aperture(s) 217 may comprise elongated slots in a cross- or X-shape.

Figure 11A:
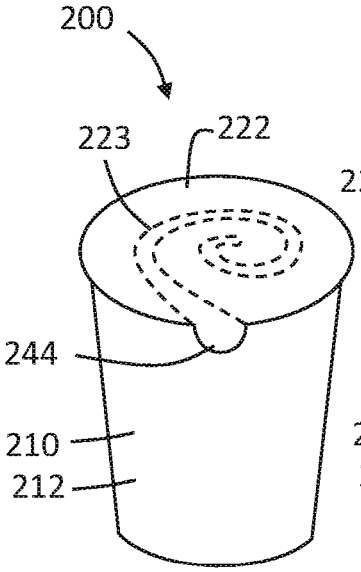
FIGS. 11A and 11B are schematic perspective views of a cartridge in a closed state and an open state, respectively, according to an embodiment.
Figure 11B:
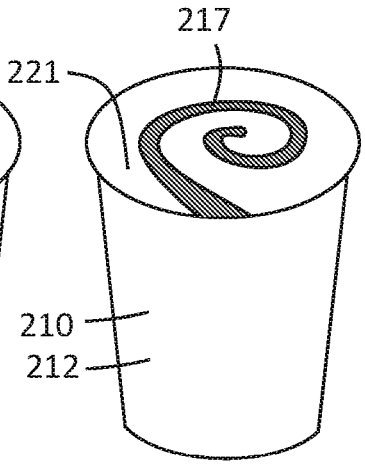
Figure 12:
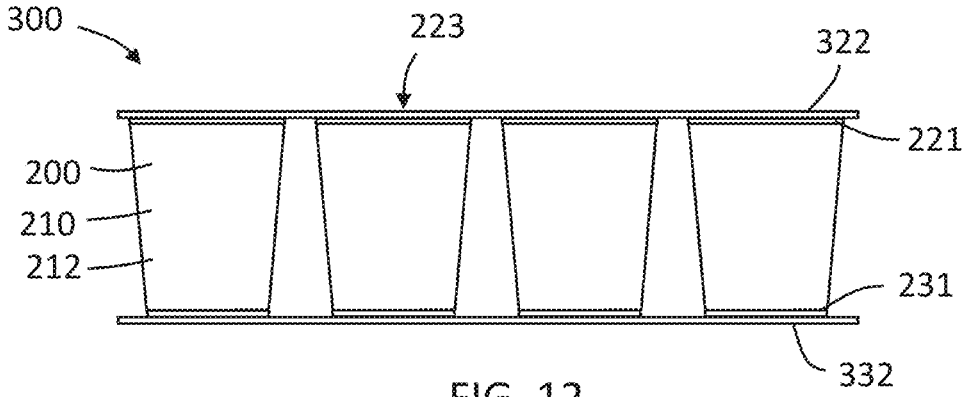
FIG. 12 is a schematic side view of cartridges in an outer packaging according to an embodiment.

The weakened region 223 may assume various regular or irregular patterns or shapes. In one exemplary embodiment shown in FIGS. 11A and 11B, the weakened region 223 and the resulting aperture(s) 217 may comprise a spiral shape.

In some embodiments, a plurality of cartridges 200 may be housed in an outer packaging 300, as shown in FIGS. 12-15. The outer packaging 300 may at least partially surround the plurality of cartridges 200. For example, the outer packaging 300 may surround or cover the top and the bottom of the cartridges 200, as shown. The outer packaging 300 may form a connected top, a connected bottom, or both a connected top and bottom for a plurality of cartridges. Although a package of four cartridges is shown, the package may include any desired number of cartridges. For example, the outer layer 222, 332 may be part of an outer packaging 300 that houses two or more, three or more, or four or more cartridges 200, or up to six, up to eight, or up to ten cartridges 200. The outer packaging 300 may form the outer layer 222, 332 of the lid 220. In embodiments where the outer packaging 300 surrounds or covers the top and the bottom of the cartridges 200, the outer packaging 300 may form the outer layer 222, 332 of the lid 220 at both the top and the bottom. The outer packaging 300 may further surround or cover at least one side of the cartridges 200 (see FIGS. 13A-13C). Each of the cartridges 200 in the outer packaging 300 may comprise an inner layer 221, 231 disposed between the outer layer 222, 332 and the body 210 of the cartridge 200.

Figure 13A:
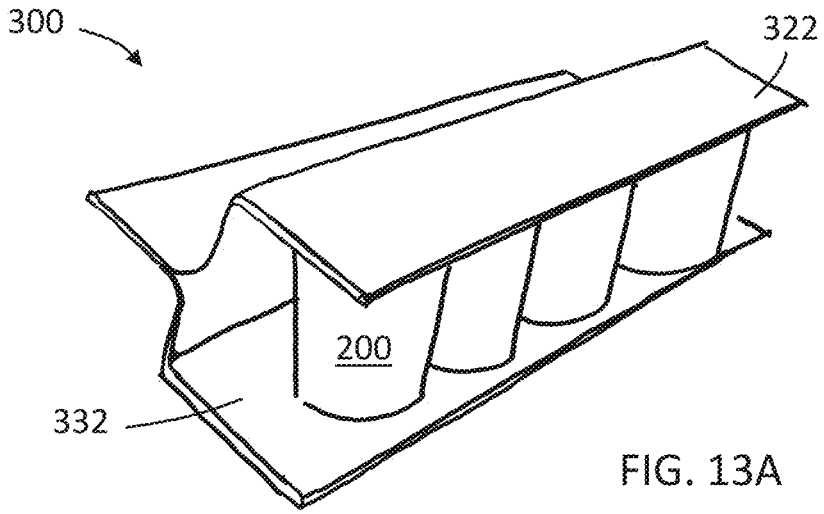
FIG. 13A is a schematic perspective view of cartridges in an outer packaging according to an embodiment.
Figure 13B:
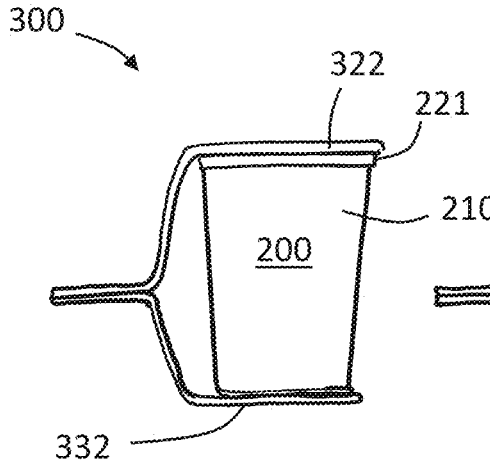
FIGS. 13B and 13C are schematic side views of a cartridge of FIG. 13A in a closed state and an open state, respectively, according to an embodiment.
Figure 13C:
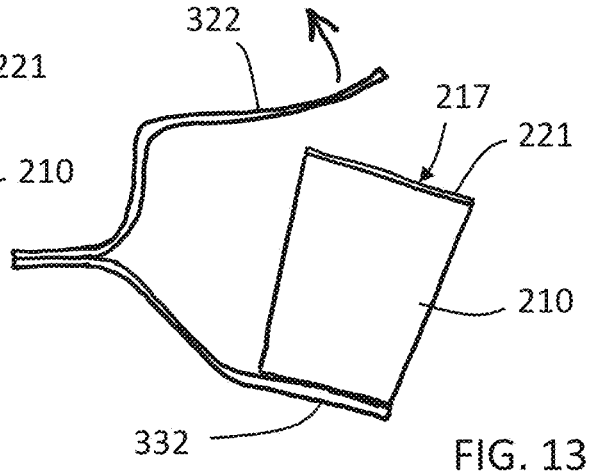
Figure 14A:
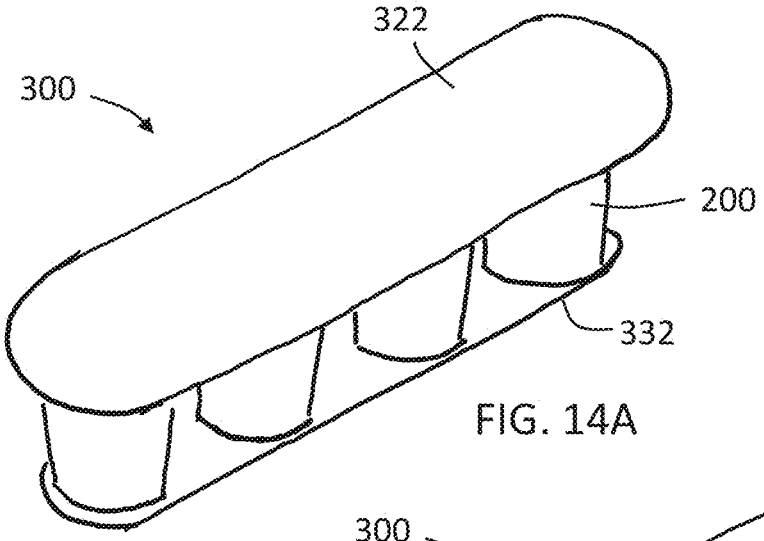
FIGS. 14A and 14B are schematic perspective views of cartridges in an outer packaging according to an embodiment.
Figure 14B:
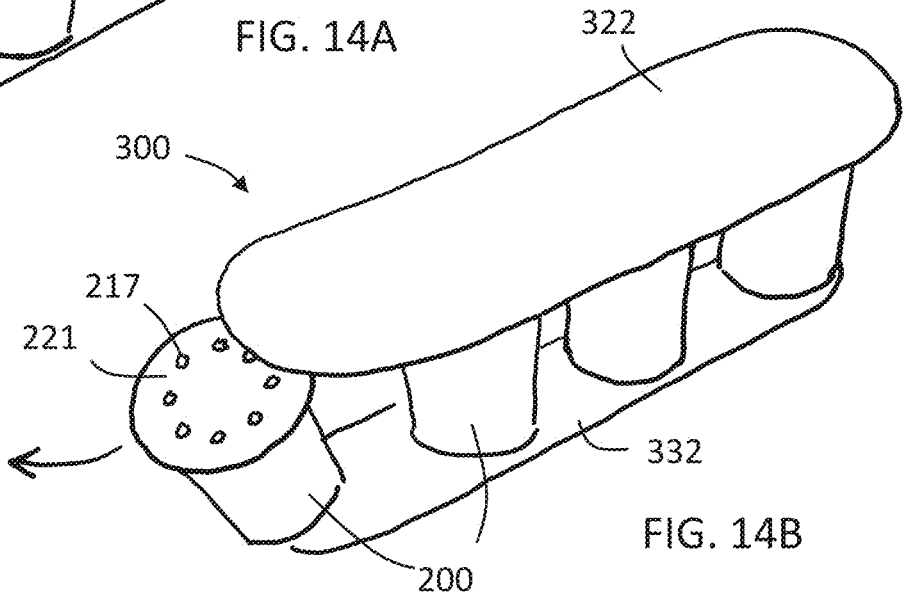

In some embodiments shown in FIGS. 13C and 14B, when a cartridge 200 is removed from the outer packaging 300, the cartridge body 210 becomes separated from the packaging 300, while the outer layer 222, 332 remains attached to the packaging 300. Removal of the cartridge 200 causes the apertures 217 to form, allowing airflow 270 through the inner layer 221, 331.

Figure 15:
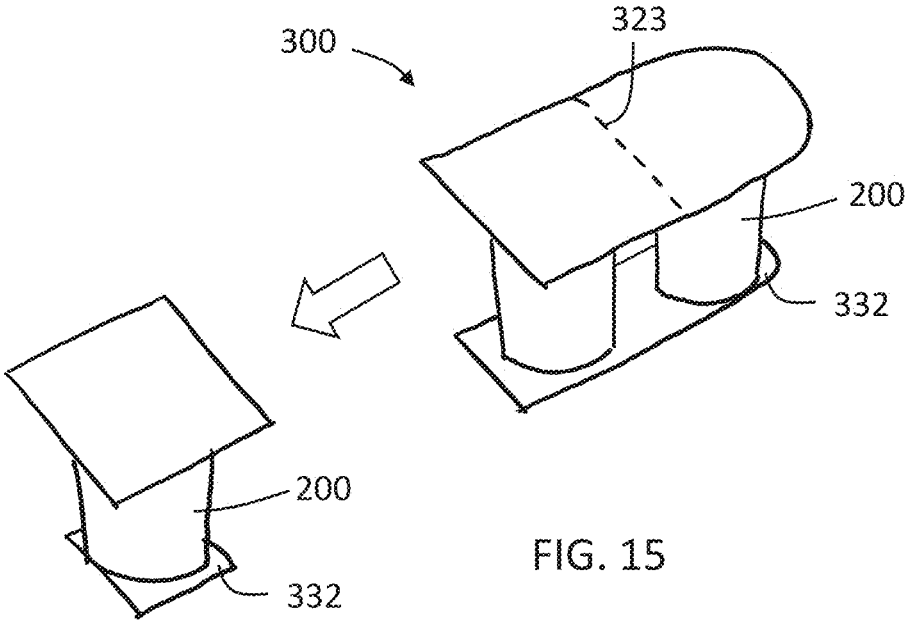
FIG. 15 is a schematic perspective view of cartridges in an outer packaging according to an embodiment.

In some embodiments, a cartridge 200 may be removed from the outer packaging 300 such that the cartridge 200, the inner layer 221, 331, and the portion 322 of the packaging that forms the outer layer 222, 332 of the lid remain intact on the cartridge, as shown in FIG. 15. The outer packaging 300 may include features that facilitate separating a portion, comprising only one cartridge, of the outer packaging 300, such as scoring or perforations 323. The outer layer 222, 332 remaining on the cartridge 200 may then be removed later from the cartridge body 210 to form apertures 217 in the weakened region 223 of the inner layer 221, 331.

Thus, cartridges for aerosol-generating devices, such as shisha devices are described. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in the mechanical arts, chemical arts, and aerosol-generating article manufacturing or related fields are intended to be within the scope of the following claims.

The invention claimed is:

1. A cartridge for housing an aerosol-forming substrate, the cartridge comprising:

a body comprising a side wall and at least one lid arranged to cover a top, a bottom, or both the top and the bottom;

a cavity inside the body;

the aerosol-forming substrate housed in the cavity, wherein the at least one lid comprises an inner layer facing the cavity and an outer layer facing an outside of the body, the inner layer comprising a weakened region, wherein removing the outer layer removes a portion of material of the inner layer, and wherein the outer layer forms a part of an outer packaging for the cartridge at least partially surrounding the body of the cartridge such that the outer packaging extends across the top and at least one side of the body, the bottom and at least one side of the body, the top and the bottom, or the top and the bottom and at least one side of the body.

2. The cartridge according to claim 1, wherein when the outer layer is removed, the weakened region of the inner layer forms an aperture.

3. The cartridge according to claim 1, wherein the outer layer and the inner layer are joined by an adhesive.

4. The cartridge according to claim 1, wherein the weakened region is formed by scoring the inner layer.

5. The cartridge according to claim 1, wherein the weakened region is formed by pressing the region on an inner side of the lid.

6. The cartridge according to claim 1, wherein the weakened region comprises a plurality of weakened regions.

7. The cartridge according to claim 6, wherein the pattern plurality of weakened regions comprises a pattern of dots.

8. The cartridge according to claim 6, wherein the plurality of weakened regions is arranged in a pattern comprises a pattern of parallel lines or non-parallel lines.

9. The cartridge according to claim 1, wherein removing the cartridge from the outer packaging causes the outer layer to be removed from the body and an aperture to be formed in the inner layer.

10. The cartridge according to claim 1 wherein the aerosol-forming substrate comprises tobacco.

11. A shisha system comprising:

a cartridge according to claim 1 with the aerosol-generating substrate disposed in the cartridge; and a shisha device comprising:

a receptacle for receiving the cartridge;

a heating element for heating the aerosol-generating substrate when the cartridge is received in the receptacle of the shisha device;

a vessel having a liquid fill level and defining a head space above the liquid fill level;

an aerosol conduit for conveying aerosol from the receptacle to the vessel; and an outlet in fluid communication with the head space.

12. A cartridge for housing an aerosol-forming substrate, the cartridge comprising:

a body comprising a side wall and at least one lid arranged to cover a top, a bottom, or both the top and the bottom;

a cavity inside the body;

the aerosol-forming substrate housed in the cavity, wherein the at least one lid comprises an inner layer facing the cavity and an outer layer facing an outside of the body, the inner layer comprising a weakened region, wherein removing a portion of the outer layer removes a portion of material of the inner layer, and wherein the outer layer forms a part of an outer packaging for the cartridge at least partially surrounding the body of the cartridge such that the outer packaging extends across the top and the bottom and of the cartridge.

13. The cartridge according to claim 12, wherein when the outer layer is removed, the weakened region of the inner layer forms an aperture.

14. The cartridge according to claim 12, wherein the weakened region is formed by scoring or perforating the inner layer or by pressing a region of the inner side of the lid.

15. The cartridge according to claim 12, wherein the aerosol-forming substrate comprises tobacco.

16. A cartridge pack comprising:

a plurality of cartridges for a shisha device, each cartridge comprising:

a body comprising a side wall, an open top, and a bottom;

a cavity inside the body;

an aerosol-forming substrate housed in the cavity; and an inner layer arranged to cover the open top, and an outer packaging forming an outer layer extending across the inner layer and forming a connected top and bottom for the plurality of cartridges, wherein removing a portion of outer layer removes a portion of material of the inner layer.

17. The cartridge pack according to claim 16, wherein when the outer layer is removed, a weakened region of the inner layer forms an aperture.

18. The cartridge pack according to claim 16, wherein a weakened region is formed by scoring or perforating the inner layer.

19. The cartridge pack according to claim 16, wherein the aerosol-forming substrate comprises tobacco.

20. The cartridge pack according to claim 16, wherein the outer packaging comprises perforations, and wherein each cartridge is configured to be removed from the outer packaging along the perforations on the outer packaging such that the cartridge, the inner layer and the outer layer of the outer packaging remain intact on the cartridge.

* * * * *